United States Patent [19]

Ruvolo

[11] 4,060,038

[45] Nov. 29, 1977

[54] ROTATING DINING ROOM TABLE

[76] Inventor: Sylvia Ruvolo, 15 Pine Tree Road, Huntington Station, N.Y. 11746

[21] Appl. No.: 717,129

[22] Filed: Aug. 24, 1976

[51] Int. Cl.[2] ..... A47B 57/00

[52] U.S. Cl. ..... 108/94; 108/104

[58] Field of Search ..... 108/103, 104, 94

[56] References Cited

U.S. PATENT DOCUMENTS

| | | | |
|---|---|---|---|
| 688,753 | 12/1901 | Storrs | 108/94 X |
| 893,210 | 7/1908 | Weeks | 108/94 |
| 1,143,279 | 6/1915 | Johnson | 108/104 X |
| 2,191,100 | 2/1940 | Starling | 108/104 X |
| 2,589,719 | 3/1952 | McKinney | 108/94 X |
| 3,437,390 | 4/1969 | Evans | 108/94 X |

*Primary Examiner*—Marion Parsons, Jr.
*Assistant Examiner*—Peter A. Aschenbrenner
*Attorney, Agent, or Firm*—Allen D. Brufsky

[57] ABSTRACT

A dining room table to facilitate serving food including inner, intermediate and outer concentric sections. The intermediate section is rotatably mounted on a pedestal to pass food around the table. The outer section includes a plurality of arcuate segments abutted about the intermediate section to provide a dining surface. The inner section supports a center piece and is fixed to the pedestal within the intermediate section.

4 Claims, 4 Drawing Figures

ROTATING DINING ROOM TABLE

BACKGROUND OF THE INVENTION

This invention relates to an article of furniture, and more particularly, to a dining room table facilitating the serving of food and retrieval of empty plates.

When serving food at a dinner party, the hostess or help must carry dishes containing food from the kitchen and either individually serve each diner at his or her seat or place a serving bowl at different locations on the dining room table. Empty plates must also be retrieved at each dining location. This is a time consuming chore necessitating a number of trips back and forth to the kitchen area from the dining room and requires a large table to support the various food items being served.

SUMMARY OF THE INVENTION

In accordance with the present invention, a dining room table is provided with an intermediate rotatable section for serving from a single location and for retrieving empty plates. The service can thus be accomplished from a cart wheeled to the serving location from the kitchen but one time, and food can be stored at this location on the cart, during dining, thereby reducing the size of the table. The rotatable section is supported on a pedestal in telescoping relation to a fixed center section for holding flowers or a decorative centerpiece. A plurality of outer arcuate segments surround the rotating section for ready removal when not required, to provide ease of access to the rotating section, but which are used by the diners to support their food plates.

BRIEF DESCRIPTION OF THE DRAWING

Further objects and advantages of the invention will become apparent from the following description and claims, and from the accompanying drawing, wherein:

DETAILED DESCRIPTION OF THE PREFERRED EMBODIMENT

Figure 1:
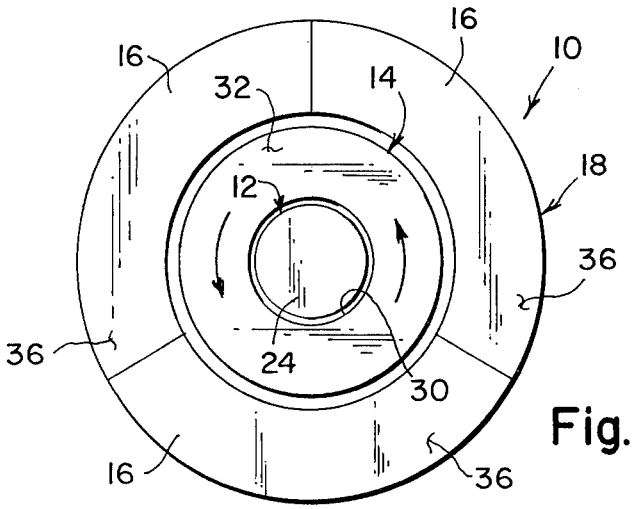
FIG. 1 is a top plan view of the table of the present invention.

Referring now to the drawing in detail, wherein like numerals indicate like elements throughout the several views, the dining room table 10 of the present invention includes a fixed center section 12, a rotatable intermediate serving section 14, and a plurality of outer segments 16, providing a dining section 18.

The fixed center section 12 includes a cylindrical standard 20 fixed to a pedestal or base 22. The standard 20 has a cylindrical disc 24 on its upper end for supporting a center piece such as a floral arrangement or the like.

Telescopically and concentrically received over standard 20 on pedestal 22 is intermediate rotatable serving section 14. Section 14 includes a cylindrical tubular housing 26 disposed over standard 20 and an upper flared or conical portion 28 having a central opening 30 receiving disc 24. Disc 24 is disposed at a slightly higher elevation than the supporting surface or end surface 32 of conical portion 28.

The housing 26 can be seated in a groove 34 on pedestal 22 for rotation or if desired, can have a wheel bearing between its lower end and pedestal 22, the upper race of the bearing attached to housing 26 and the lower race attached to pedestal 22.

Figure 2:
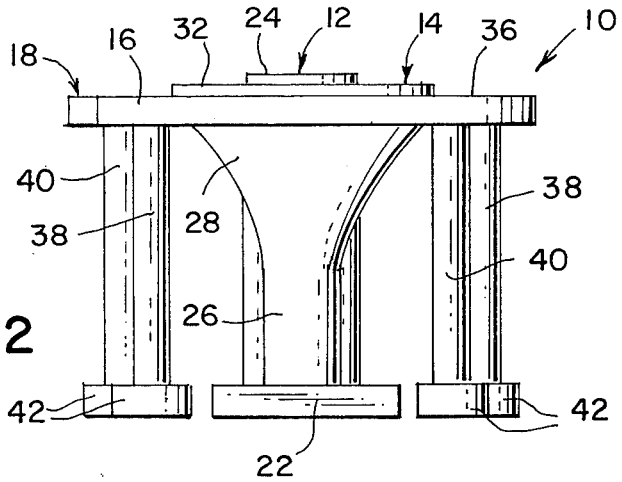
FIG. 2 is a side view in elevation of the table of FIG. 1.
Figure 3:
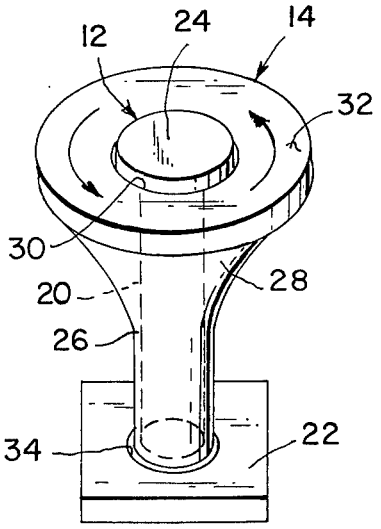
FIG. 3 is a perspective view of the innermost and rotatable intermediate section of the table of FIG. 1.
Figure 4:
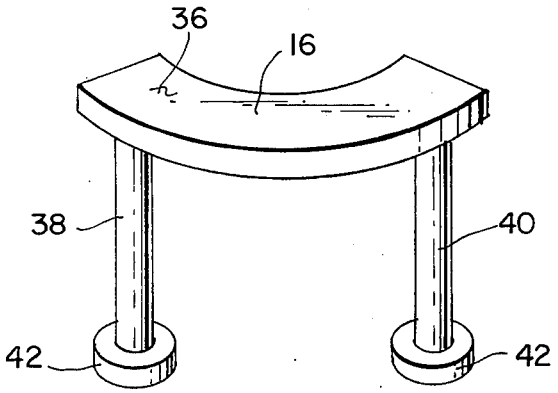
FIG. 4 is a perspective view of one of the outermost sections of the table of FIG. 1.

The outer segments 16 of dining section 18 each include an arcuate support surface 36 removably supported by a pair of legs 38, 40 terminating in foot pads 42 in concentric relation with intermediate section 14 to form a circle. If not needed for dining space, one or more of the segments 16 can be removed and a serving cart placed in its stead adjacent rotatable section 14 for ease of access. As shown in FIG. 2, surface 36 is slightly below surface 32 of intermediate section 14 so food passed about each segment 16 on surface 32 is readily accessible to a diner.

I claim:

1. A rotatable dining room table comprising:

a pedestal, a relatively fixed inner section supported on said pedestal, said inner section having an upper support surface for a centerpiece, an intermediate serving section rotatably mounted on said pedestal in concentric relation to said inner section, said intermediate section having an upper support surface concentrically disposed relative to the upper support surface on said inner section, and an outer dining section supported in concentric relation to said inner and intermediate sections, said outer section including a plurality of arcuate segments arranged about said intermediate section in a circle, each segment having a planar support surface individually supported, on a pair of vertical support legs, adjacent the upper support surface of said intermediate sections.

2. The table of claim 1 wherein said inner section includes a cylindrical standard supporting its upper support surface on said pedestal, and said intermediate section includes a cylindrical housing telescopically received over said standard and having an upper conical portion provided with a central opening for circumscribing the upper support surface of said inner section.

3. The table of claim 2 wherein said cylindrical housing is rotatably seated in a groove on said pedestal.

4. The table of claim 3 wherein the upper support surfaces on said inner, intermediate, and outer sections, are at stepped elevations.

* * * * *